US005888176A

United States Patent [19]

Kuo

[11] Patent Number: 5,888,176

[45] Date of Patent: Mar. 30, 1999

[54] STEPPING EXERCISER

[76] Inventor: Hui Kuei Kuo, No. 19, Lane 640, Gien Gong Road, San Min Chu, Kaohsiung, Taiwan

[21] Appl. No.: 58,936

[22] Filed: Apr. 13, 1998

[51] Int. Cl.[6] ..... A63B 22/04

[52] U.S. Cl. ..... 482/53; 482/62

[58] Field of Search ..... 482/51, 52, 53, 482/57, 62, 147, 79, 80

[56] References Cited

U.S. PATENT DOCUMENTS

| | | | |
|---|---|---|---|
| 4,509,742 | 4/1985 | Cones | 482/62 |
| 4,555,109 | 11/1985 | Hartmann | 482/62 |
| 4,586,706 | 5/1986 | Chen | 482/62 |
| 5,545,111 | 8/1996 | Wang et al. | 482/53 |
| 5,645,512 | 7/1997 | Yu | 482/53 |
| 5,749,809 | 5/1998 | Lin | 482/52 |

*Primary Examiner*—Stephen R. Crow

[57] ABSTRACT

An exerciser includes a pair of foot pedals pivotally secured to a base at a pivot axle, and a wheel rotatably secured on the upper portion of the base at a pivot shaft. A cable couples the wheel to the foot pedals for allowing the wheel to be rotated by the foot pedals. A post is pivotally secured to the pivot shaft and includes a handle. A pin may selectively secure the post to the wheel for allowing the post to be rotated in concert with the wheel when the pin secures the post to the wheel. An actuator may apply a resistive force against the foot pedals.

4 Claims, 5 Drawing Sheets

STEPPING EXERCISER

BACKGROUND OF THE INVENTION

1. Field of the Invention

The present invention relates to a stepping exerciser, and more particularly to a stepping exerciser having a rotatable handle.

2. Description of the Prior Art

Typical stepping exercisers may be used for conducting stepping exercises. The users may not exercise the waist portion with such stepping exercisers.

The present invention has arisen to mitigate and/or obviate the afore-described disadvantages of the conventional stepping exercisers.

SUMMARY OF THE INVENTION

The primary objective of the present invention is to provide a stepping exerciser which includes a handle that may be selectively coupled to the foot pedals for allowing the user to conduct stepping exercises and/or for allowing the user to exercise the waist portion.

In accordance with one aspect of the invention, there is provided an exerciser comprising a base including an upper portion, a pair of foot pedals pivotally secured to the base at a pivot axle, a wheel rotatably secured on the upper portion of the base at a pivot shaft, means for coupling the wheel to the foot pedals, a post pivotally secured to the upper portion of the base at the pivot shaft and including a handle provided on top thereof, and means for selectively securing the post to the wheel. The post is secured to the wheel and rotated in concert with the wheel when the selectively securing means secures the post to the wheel.

The coupling means includes a cable engaged around the wheel and having two ends secured to the foot pedals for coupling the wheel to the foot pedals. The wheel includes a notch, the cable includes a key for engaging with the notch and for securing the cable to the wheel.

A resistive means is further provided for applying a resistive force against the foot pedals.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
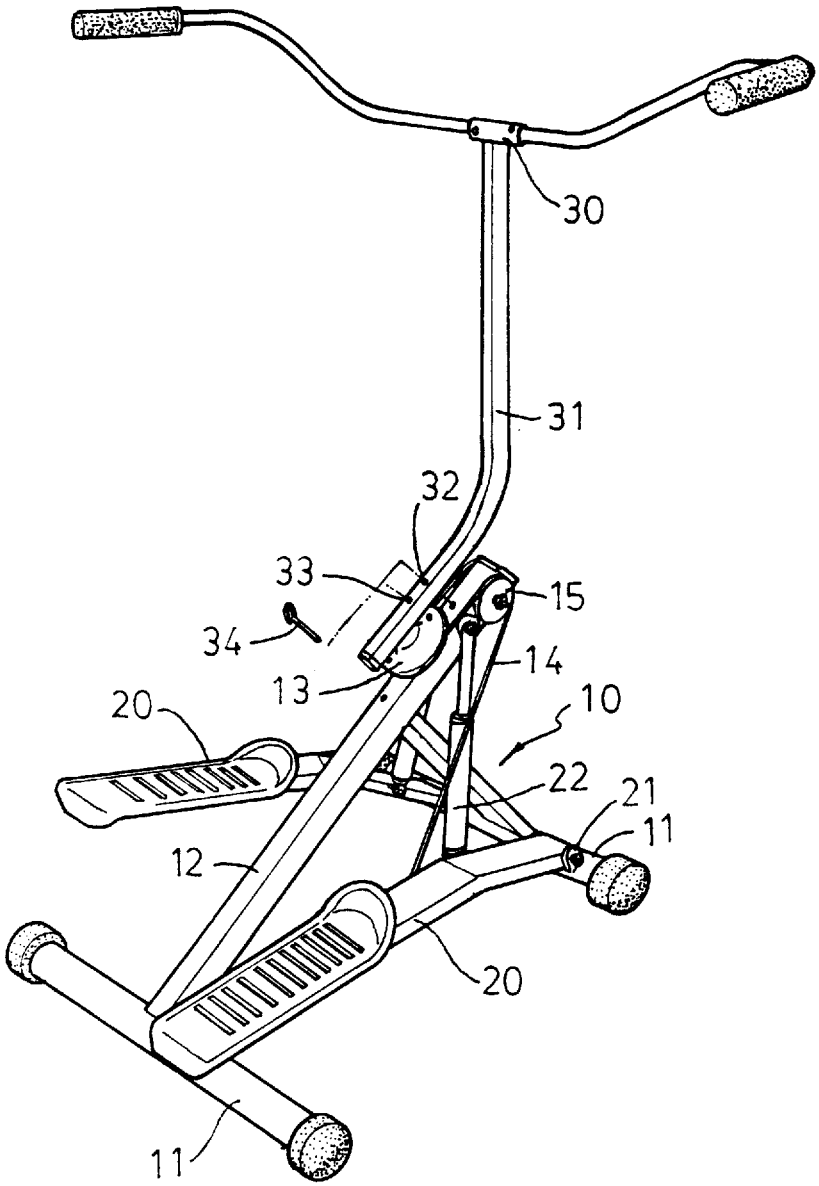
FIG. 1 is a perspective view of a stepping exerciser in accordance with the present invention.
Figure 2:
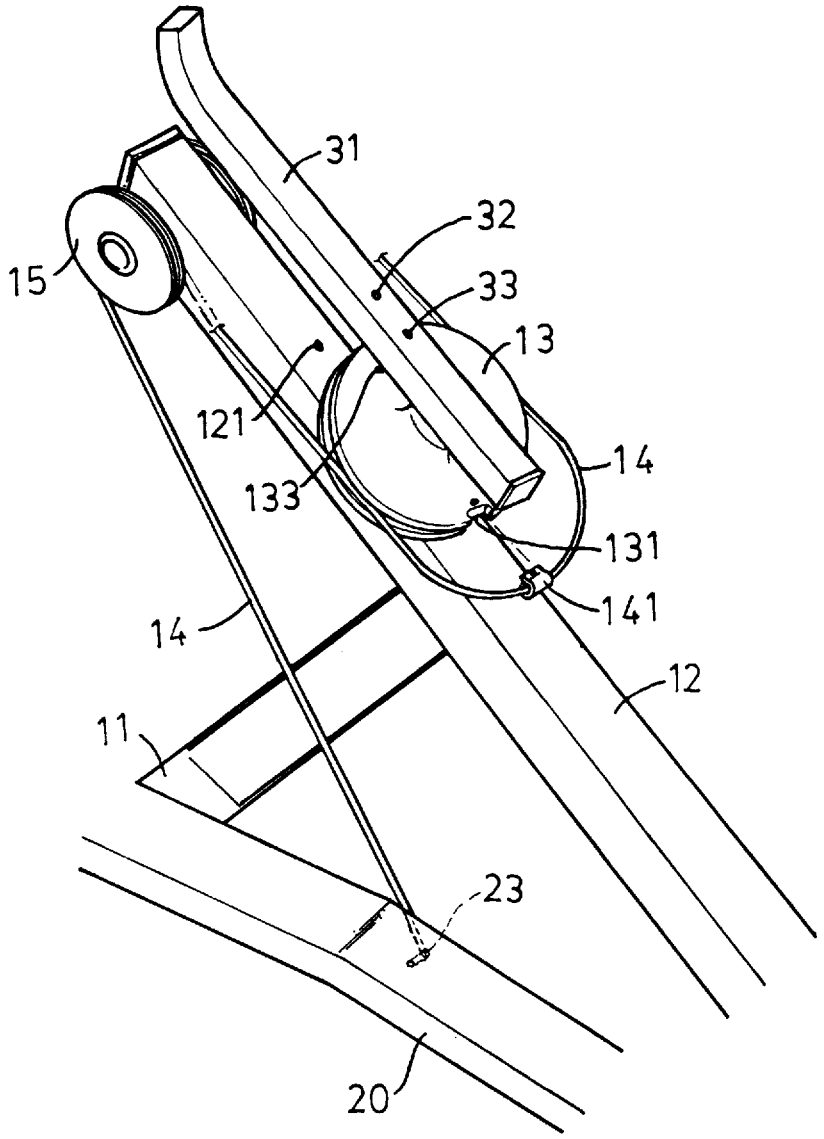
FIG. 2 is a partial perspective view of the stepping exerciser.
Figure 3:
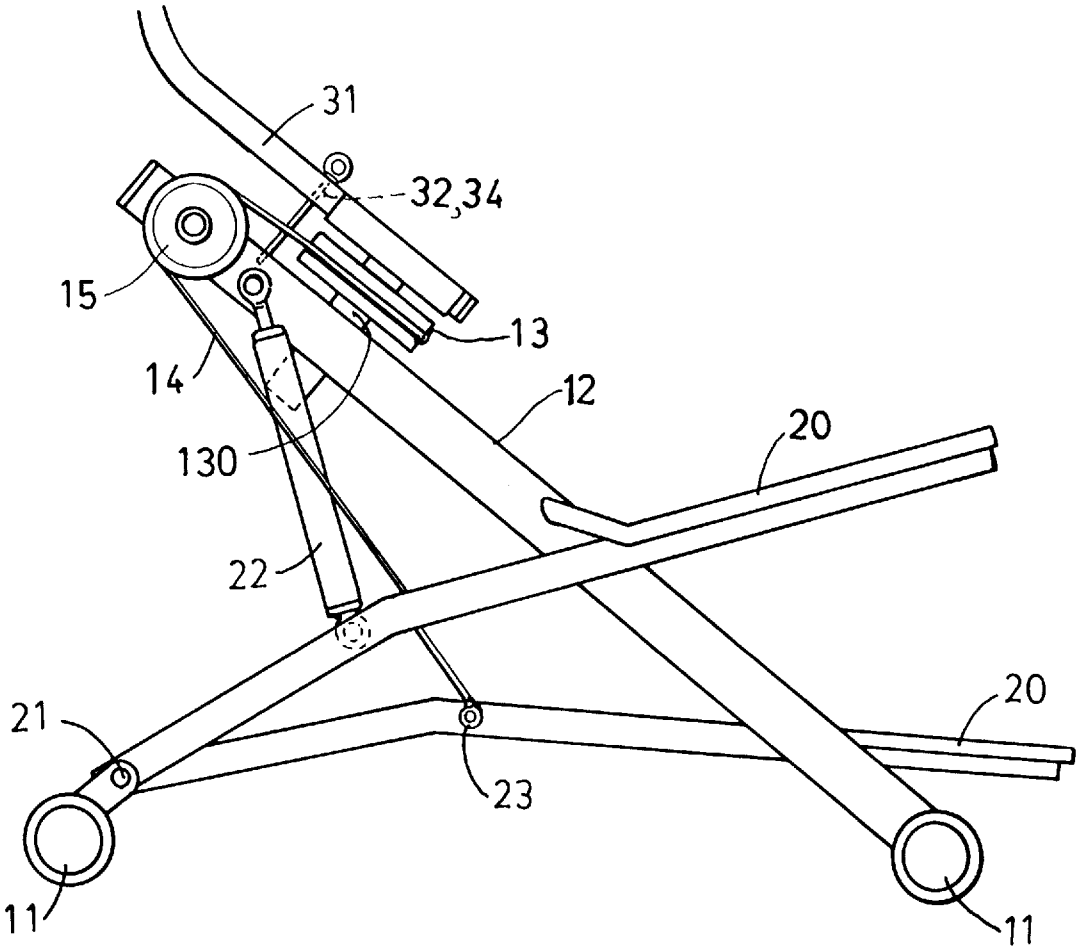
FIGS. 3 and 4 are partial plan views illustrating the operation of the stepping exerciser.

Referring to the drawings, and initially to FIGS. 1–3, a stepping exerciser in accordance with the present invention comprises a base 10 including two rods 11 provided in the front and rear portions for forming a horizontal bottom and including a beam 12 secured on the base 10 and inclined relative to the horizontal bottom of the base 10. A pair of foot pedals 20 each includes a front end pivotally coupled to the base 10 at a pivot axle 21 for allowing the foot pedals 20 to be rotated about the pivot axles 21 respectively. A pair of actuators, such as pneumatic or hydraulic cylinders 22 are coupled between the foot pedals 20 and the beam 12 for applying a resistive force against the rotational movement of the foot pedals 20 about the pivot axles 21. Two pulleys 15 are rotatably secured on top of the beam 12.

A wheel 13 is pivotally secured to the upper portion of the beam 12 at a pivot shaft 130. A cable 14 is engaged around the wheel 13 and the pulleys 15 and has two ends secured to the foot pedals 20 by fasteners 23 for coupling the foot pedals 20 together and for allowing one of the foot pedals 20 to be moved upward when the other foot pedal 20 moved downward. The wheel 13 includes a notch 131. The cable 14 includes a key 141 for force-fittedly engaging with the notch 131 of the wheel 13 or for securing to the notch 131 of the wheel 13 by such as adhesive materials, and for allowing the wheel 13 to be rotated by the cable 14 when the cable 14 is moved by the foot pedals 20.

Figure 4:
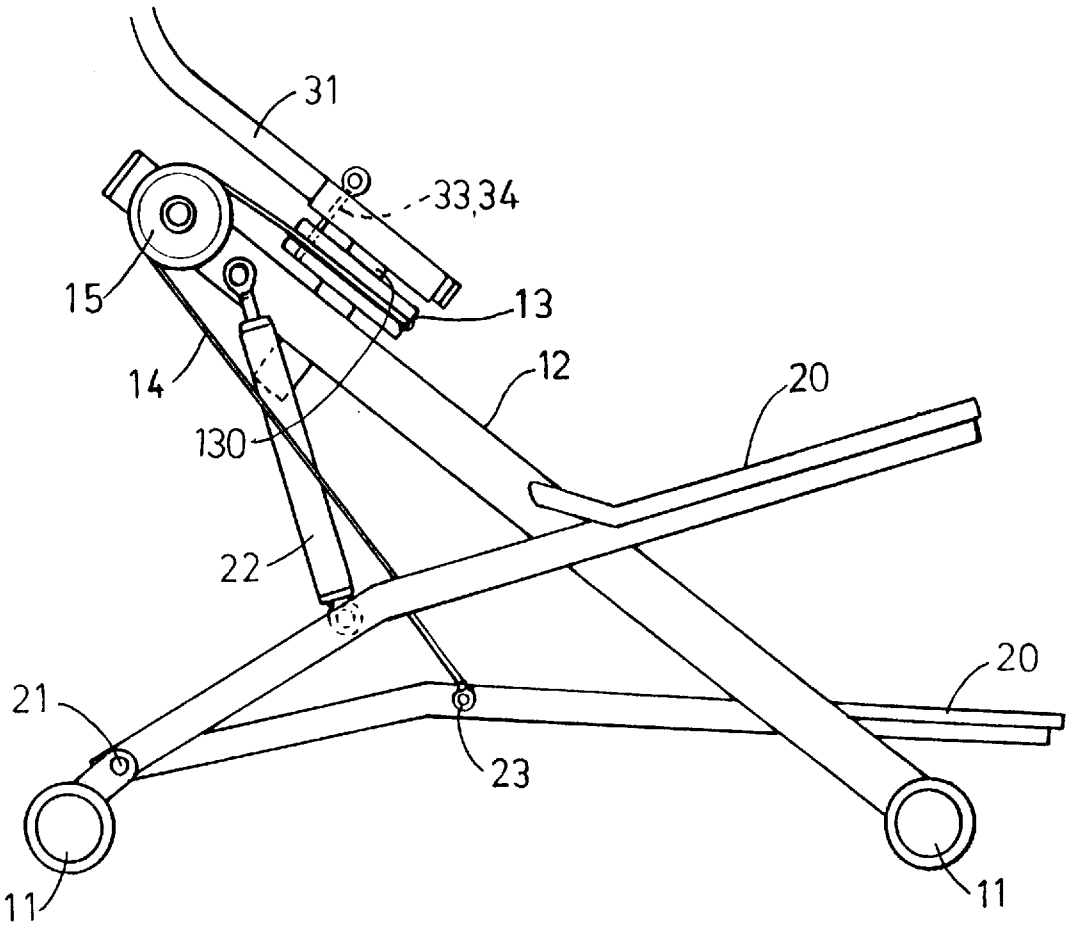
Figure 5:
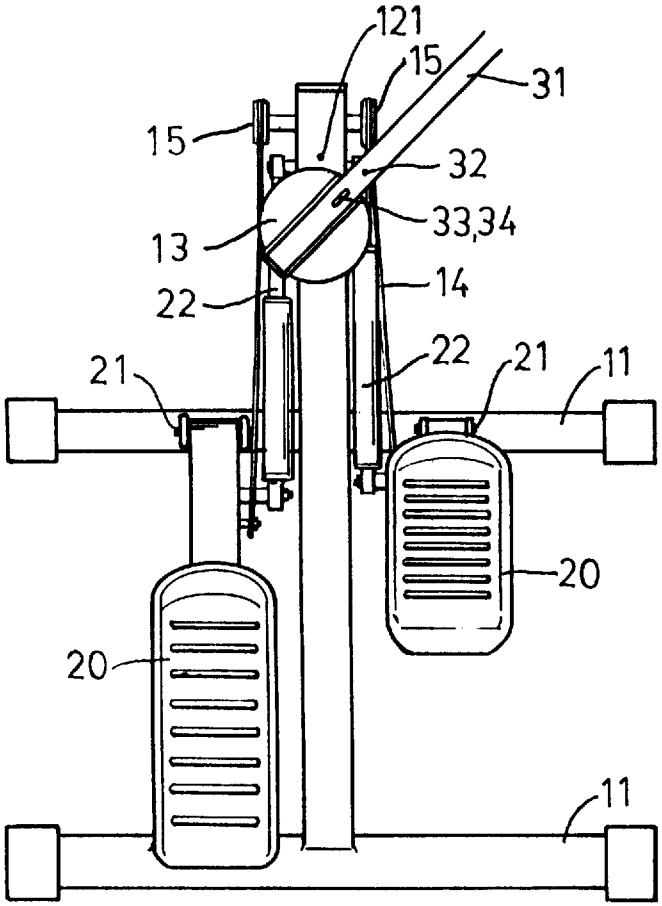
FIGS. 5 and 6 are partial top views illustrating the operation of the stepping exerciser.
Figure 6:
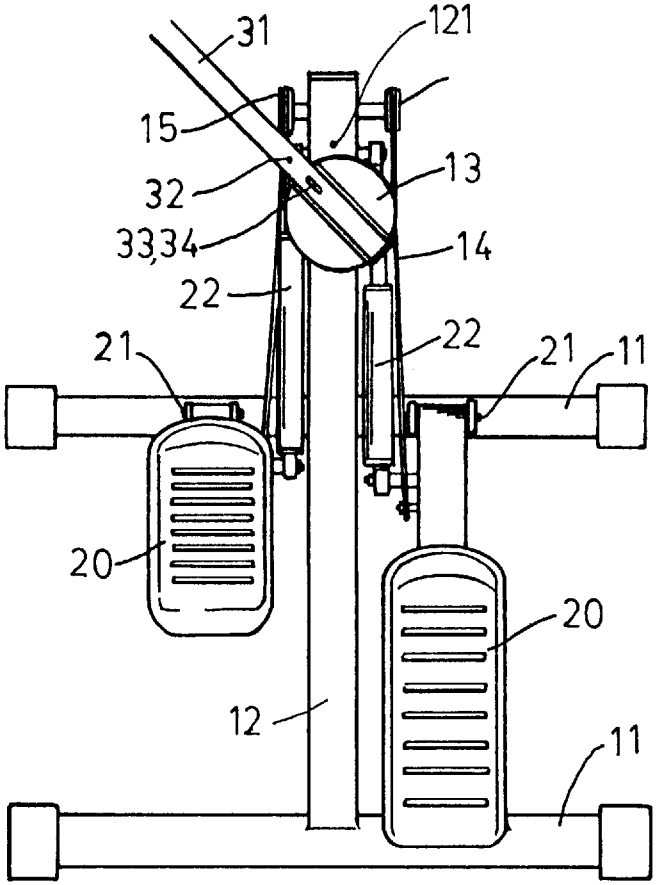

A handle 30 is secured on top of a post 31 which includes a lower portion secured to the pivot shaft 130 (FIGS. 3, 4) and which includes two holes 32, 33 for selectively engaging with a pin 34. The post 31 and the wheel 13 may be solidly or rotatably secured to the pivot shaft 130. For example, both the post 31 and the wheel 13 may be solidly secured to the pivot shaft 130 and rotated in concert with the shaft 130. When the post 31 may rotate relative to the wheel, the pin 34 may engage with the hole 33 of the post 31 and the hole 133 of the wheel 13 (FIGS. 3, 5, 6) for securing the post 31 to the wheel 13 and for allowing the post 31 and the wheel 13 to be rotated in concert with each other. When the pin 34 is engaged with the hole 32 of the post 31 and the hole 121 of the beam 12 (FIG. 4), the post 31 and the handle 30 may be solidly secured to the base 10. At this moment, only the wheel 13 may be rotated by the cable 14 and the foot pedals 20.

It is to be noted that the post 31 and the wheel 13 may both be rotatably secured to the shaft 130. Or, the post 31 may be solidly secured to the shaft 130 and the wheel 13 is rotatably secured to the shaft 130. Or, alternatively, the post 31 may be rotatably secured to the shaft 130 and the wheel 13 is solidly secured to the shaft 130. In all these three conditions, the post 31 may be rotated relative to the wheel 13. It is further to be noted that the pivot shaft 130 is not vertical but inclined relative to the horizontal bottom of the base 10, and the post 31 is secured to and rotatable about the pivot shaft 130, such that the post 31 and the handle 30 may be rotated about the pivot shaft 130 that is not vertical and that is inclined relative to the horizontal bottom.

Accordingly, the stepping exerciser in accordance with the present invention includes a handle that may be selectively coupled to the foot pedals for allowing the user to conduct stepping exercises and/or for allowing the user to exercise the waist portion.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An stair stepping exerciser comprising:

a base including an upper portion, a pair of foot pedals pivotally secured to said base at a pivot axle, a wheel rotatably secured on said upper portion of said base at a pivot shaft, means for coupling said wheel to said foot pedals, a post pivotally secured to said upper portion of said base at said pivot shaft and including a handle provided on top thereof, and means for selectively engaging or disengaging said post to said wheel, said post being engaged to said wheel and rotated in concert with said wheel when said selectively securing means engages said post to said wheel.

2. The exerciser according to claim 1, wherein said coupling means includes a cable engaged around said wheel and having two ends secured to said foot pedals for coupling said wheel to said foot pedals.

3. The exerciser according to claim 2, wherein said wheel includes a notch, said cable includes a key for engaging with said notch and for securing said cable to said wheel.

4. The exerciser according to claim 1 further comprising means for applying a resistive force against said foot pedals.

* * * * *